US006649842B1

(12) United States Patent
Nishino

(10) Patent No.: US 6,649,842 B1
(45) Date of Patent: Nov. 18, 2003

(54) POWER FEEDING FACILITY AND ITS CABLE FOR HIGH-FREQUENCY CURRENT

(75) Inventor: Shuzo Nishino, Osaka (JP)

(73) Assignee: Daifuku Co., Ltd. (JP)

( * ) Notice: Subject to any disclaimer, the term of this patent is extended or adjusted under 35 U.S.C. 154(b) by 0 days.

(21) Appl. No.: 09/889,421

(22) PCT Filed: Feb. 10, 1999

(86) PCT No.: PCT/JP00/00600

§ 371 (c)(1),
(2), (4) Date: Jul. 17, 2001

(87) PCT Pub. No.: WO00/48205

PCT Pub. Date: Aug. 17, 2000

(30) Foreign Application Priority Data

Feb. 10, 1999 (JP) ..... 11-032084
Jan. 6, 2000 (JP) ..... 2000-005695

(51) Int. Cl.[7] ..... H01B 7/00
(52) U.S. Cl. ..... 174/110 R; 174/113 R
(58) Field of Search ..... 174/32, 33, 36, 174/110 R, 113 R, 113 C, 116, 119 R; 333/12

(56) References Cited

U.S. PATENT DOCUMENTS 336,992 A * 3/1886 Clark ..... 174/32
1,551,275 A * 8/1925 Wagner et al. ..... 174/32
1,625,125 A * 4/1927 Latour ..... 174/34
2,373,906 A * 4/1945 Mouridian ..... 370/200
4,035,751 A * 7/1977 Walthew ..... 336/107
4,149,170 A * 4/1979 Campbell et al. ..... 333/12
5,182,427 A * 1/1993 McGaffigan ..... 219/494
5,763,825 A * 6/1998 Gilliland ..... 174/36
5,966,056 A * 10/1999 Thornton ..... 333/5
6,506,971 B1 * 1/2003 Grach et al. ..... 174/32

FOREIGN PATENT DOCUMENTS

JP 08175232 A * 7/1996 ..... B60M/7/00
JP 08308153 A 11/1996
WO WO 96/20526 7/1996

* cited by examiner

*Primary Examiner*—William H. Mayo, III
(74) *Attorney, Agent, or Firm*—Mark Kusner; Michael A. Jaffe

(57) ABSTRACT

A cable for use in a high-frequency current feeding equipment constituted by passing an inner bundle (A) of wires (2) disposed at the same distance from the center of multiconductor cable (1) and outer bundles (B and C) of wires (3) through a ferrite (5) in such a way that the ampere-turns thereof are the same. The counter-electromotive force generated because of the difference of the spatial arrangement between the inner wires (2) and the outer wires (3) caused when stranded is canceled, and the current phases and current values of the wires (2 and 3) are forced to be exactly the same. Therefore, an increase in the resistance due to the proximity effect is prevented, and thereby the multiconductor cable (1) can be used as a high-frequency current cable.

4 Claims, 12 Drawing Sheets

(a)

(b)

POWER FEEDING FACILITY AND ITS CABLE FOR HIGH-FREQUENCY CURRENT

TECHNICAL FIELD

The present invention relates to a high frequency current multiconductor cable and a feeding equipment for one or more movable bodies using the high frequency current multiconductor cable.

BACKGROUND OF THE INVENTION

As for a known feeding equipment for feeding high frequency current from a power source by using a high frequency current multiconductor cable, there is one disclosed, e.g., in Japanese Patent Kokai Hei 6-153305.

In the feeding equipment, a line (induction line) to which a given high frequency current is fed from a power source device is laid along a guide rail (an example of movable line) for a carriage (an example of movable body), and the carriage is provided with a pickup coil which is fed from the induction line in a noncontact manner. In the carriage, connected in parallel with the pickup coil is a capacitor cooperating with the pickup coil to constitute a resonance circuit which resonates at the frequency of the induction line, the capacitor having a rectifying/smoothing circuit connected thereto. Further, connected to this rectifying/smoothing circuit is a stabilization power circuit for maintaining the output voltage at a reference value. Through an inverter, this stabilization power circuit feeds a motor, corresponding to a load, connected to the traveling wheels of the carriage.

The high frequency current fed from the power source device to the induction line concentrates near the conductor surface due to the skin effect, which means that the effective cross-sectional area of the conductor decreases, with the result that the resistance of the line becomes higher than when dc current is passed through the line; the resistance also increases with increasing frequency. In order to avoid the loss caused by the resistance increasing due to the skin effect, a litz wire (enamel-coated, small-diameter conductors stranded together) is widely used as a cable used as a line for passing high frequency current therethrough.

However, the known cable described above poses the following problems.

1. The cable using the litz wire makes it necessary to remove the enamel and solder when it is to be connected; thus, the terminal preparation is troublesome and it is difficult to maintain the quality and reliability of such terminal preparation.
2. Litz wires, which are expensive, form a factor in high installation cost.

To solve such problems in a simple manner, it may be contemplated to use a multiconductor cable formed by bundling a plurality of vinyl-coated conductors. Multiconductor cables require no soldering and allow the use of conventional crimp terminals, thus extremely facilitating the terminal preparation, and their cost is about half that of litz wires.

However, as a factor which causes an increase in the resistance of the line when high frequency current is passed therethrough, besides the skin effect, there is the proximity effect. This occurs in such a manner that when a conductor is present in the proximity of an opposed conductor, high frequency current which concentrates near the surface of the conductor due to the skin effect produces a counter electromotive force in the opposed conductor, changing the current distribution.

The multiconductor cable brings about a difference in current phase between the conductors disposed at different distances from the center. And the nearer to the center is an electric wire disposed, the greater is the number of electric wires from which it receives the effect; therefore, as shown in FIG. 12, electric wires disposed nearer to the center have, as a result, a current y flowing therethrough which has a component opposite in direction to a current x which flows through outer electric wires, so that a circulating current flows through the line, resulting in an increase in resistance. Since passing a large, high frequency current is attended by a large loss due to this resistance, the multiconductor cable has not been suitable for use as a line for passing high frequency current. In FIG. 12, a multiconductor cable 31 is used as a high frequency current cable with the electric wires 32 bundled at each end and having a crimp terminal 33 attached thereto.

In addition, the proximity effect can hardly be removed by the use of a litz wire. Particularly, in the terminal preparation, a number of litz wires are simultaneously soldered for unification, whereby a difference in current phase tends to occur due to the difference in spatial arrangement when individual litz wires are stranded, thus resulting in an increase in resistance.

BRIEF SUMMARY OF THE INVENTION

Accordingly, the invention has an object to solve the problems by providing a high frequency current multiconductor cable and a feeding equipment for one or more movable bodies using the high frequency current multiconductor cable, which cable suffers less loss due to resistance when high frequency current is passed and therefore is usable as an induction cable, besides being inexpensive and easy to prepare its terminals.

To achieve this object, the high frequency current multiconductor cable of the invention is a multiconductor cable comprising a plurality of covered electric wires, characterized in that a current balancing circuit is added for high frequency current flowing through each electric wire, and the current balancing circuit is formed by bundling electric wires equi-spaced from the center of the cable and by passing the bundles through a magnetic body in such a manner that ampere-turns or current densities become the same among the wires.

According to such arrangement, the counter electromotive force produced due to the difference in spatial arrangement when the electric wires of the feeder are stranded is cancelled by a current balancing circuit, forcing the individual electric wires of the feeder to take exactly the same current phase and current value, with the result that an increase in resistance due to the proximity effect is prevented; therefore, a line which suffers less resistance loss is obtained.

Further, a power feeding equipment for one or more movable bodies which uses the high frequency current multiconductor cable of the invention is a feeding equipment comprising an induction line extending along a moving path of the one or more moving bodies and supplying a constant high frequency current from a power source device, and a pickup coil provided in each moving body and being fed with power from the induction line in a contactless manner, characterized in that the foregoing induction line is formed by using the high frequency current multiconductor cable.

According to such arrangement, even when the induction line is arranged to extend for a long distance, an increase in resistance due to the proximity effect can be suppressed by means of the current balancing circuit, and the induction line can be formed by using the multiconductor cable. Furthermore, the use of the multiconductor cable eliminates the need for soldering, facilitates the terminal preparations, largely improves working efficiency in laying out the cable, and reducing the cost of forming the induction line to about half as compared with the case of using a litz wire to form the induction line, thereby realizing a cost reduction to a great extent.

DETAILED DESCRIPTION OF THE INVENTION

Embodiment 1

Figure 1:
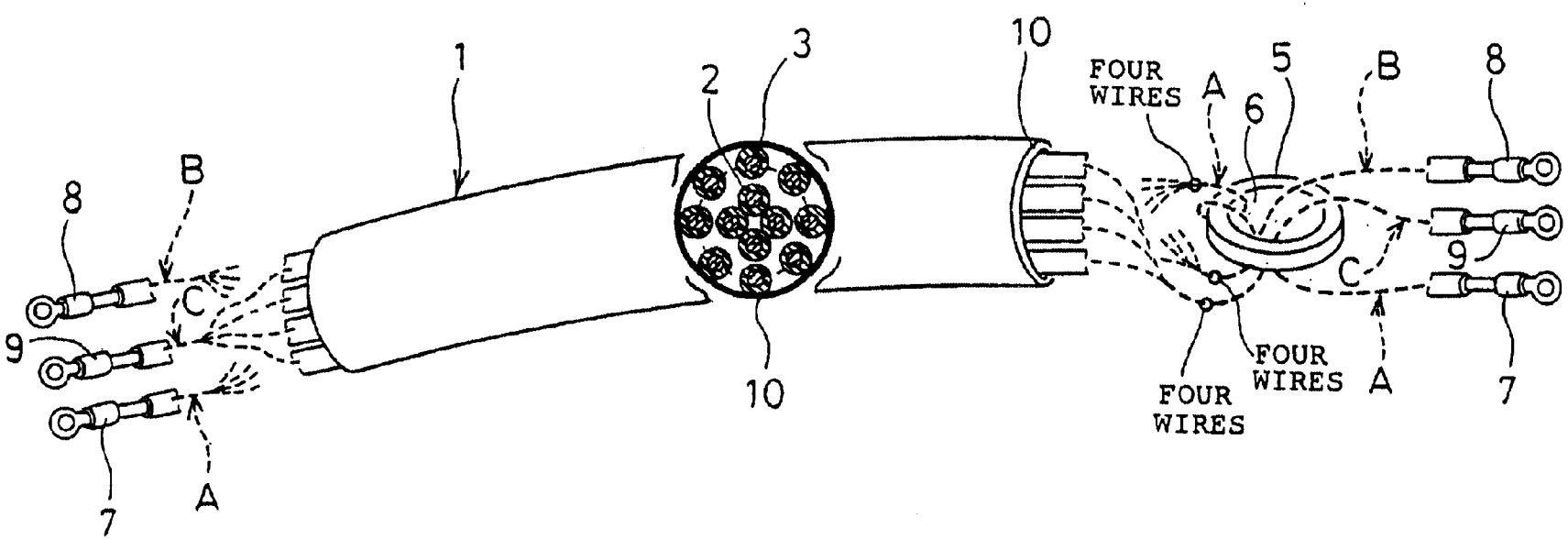
FIG. 1 is a structural view, partly in section, of a high frequency current multiconductor cable used as a line for passing high frequency current for a feeding equipment in an embodiment 1 of the invention.

In FIG. 1, the numeral 1 denotes a high frequency current multiconductor cable. As shown enlarged in FIG. 2(*a*), four electric wires (core wires) 2 equispaced from the center of the cable 1 are disposed in an inner region in the cable 1, and disposed outwardly thereof and equispaced from the center are electric wires 3 whose number is an integral multiple of the number of inner electric wires 2 (twice, or 8 in FIG. 1). Further, the cross-sectional area of the conductor 11 of the electric wire 2 is equal to that of the conductor 11 of the electric wire 3. Further, the bundle of four inner electric wires 2 is named A, and the two bundles each consisting of four (the same as the number of inner electric wires 2) outer electric wires 3 are respectively named B and C.

Further, in FIG. 1, the numeral 5 denotes a ring-shaped ferrite body (an example of magnetic material) constituting a current balancing circuit, and with respect to this ferrite body 5, as shown, the bundle A of four inner electric wires 2 is passed through a hole 6 in the ferrite body 5 once, then around the outside of the ferrite body 5 and again though the hole 6 in the ferrite body 5 in the same direction. Further, the two bundles B and C of outer electric wires 3 are passed through the hole 6 in the ferrite body 5 in a direction opposite to the direction of passage of the bundle A of inner electric wires 2.

Such way the electric wires 2 and 3 are wound around the ferrite body 5 equalizes the ampere-turns for the inner and outer electric wires 2 and 3, thereby canceling the counter electromotive force produced from the difference in spatial arrangement when the inner and outer electric wires 2 and 3 of the multiconductor cable 1 are twisted together, so that the current phases and current values for the electric wires 2 and 3 of the multiconductor cable 1 are forced to be exactly the same. Therefore, the circulating current flowing through the multiconductor cable 1 is cut off, with the result that an increase in resistance due to the proximity effect is prevented and the resistance loss is reduced. As a result, it becomes possible to use the multiconductor cable 1 as a high frequency current multiconductor cable.

The number of electric wires 3 disposed outwardly of the electric wires 2 disposed inside and equispaced from the center is an integral multiple of the number of electric wires 2, as described above; therefore, when the electric wires equispaced from the center of the cable are bundled and passed through the ferrite body 5, the ampere-turns can be easily made equal, the efficiency of laying operation can be improved, and the cost can be reduced.

Further, as shown in FIG. 1, the bundle A of inner electric wires 2 have first crimp terminals 7 attached to the opposite ends thereof, and the bundles B and C of outer electric wires 3 have second and third crimp terminals 8 and 9 attached to the opposite ends thereof, respectively. In FIG. 1, the numeral 10 denotes a cover for the multiconductor cable 1.

Figure 2:
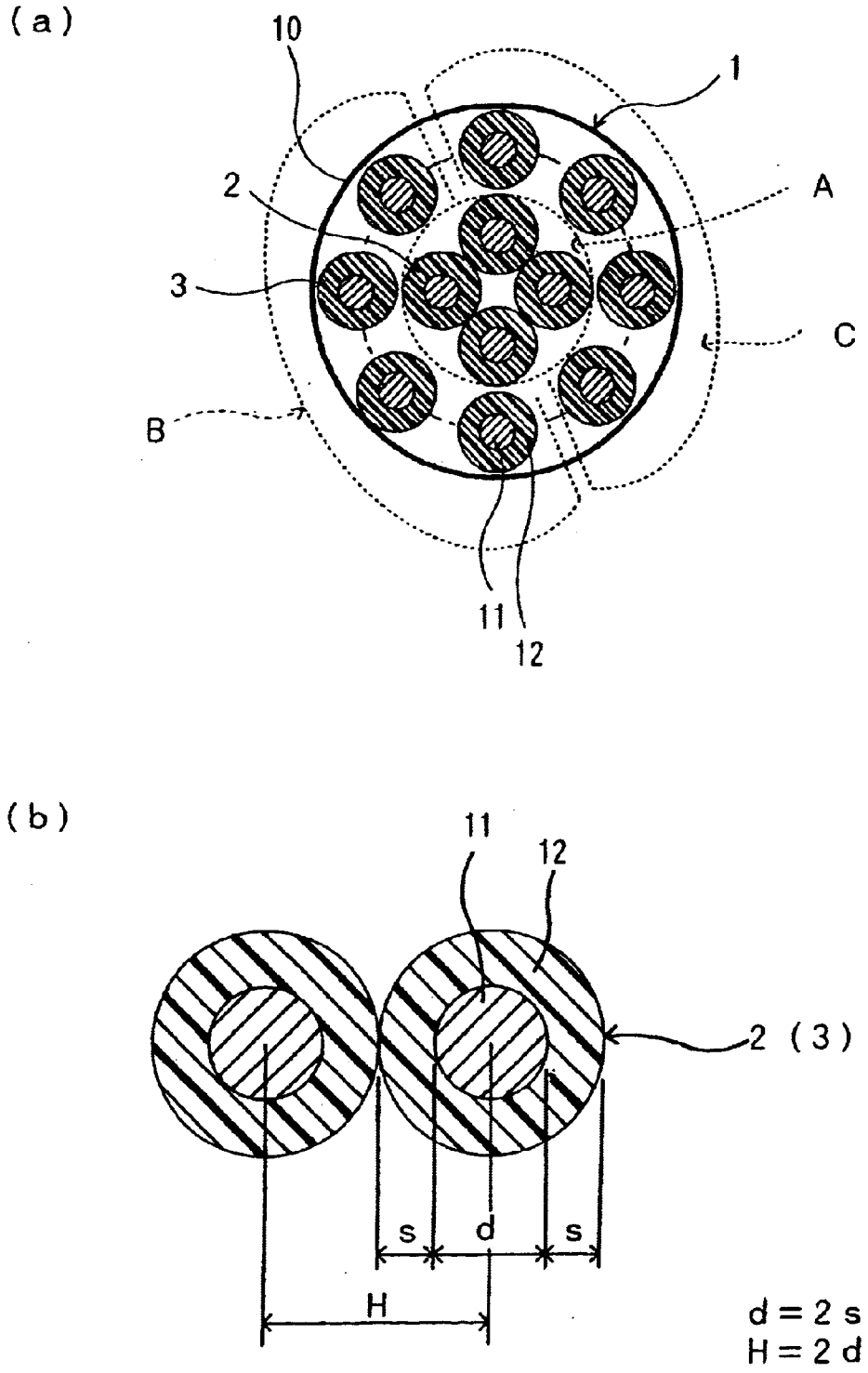
FIGS. 2(*a*) & 2(*b*) are an explanatory view, in section, of the electric wires of the high frequency current multiconductor cable for the feeding equipment.

Further, the electric wires 2 and 3, as shown in FIG. 2(*b*), have the diameter d of their conductors 11 so dimensioned that the diameter d is equal to twice the sum of the thickness a of the cover of the conductor 11 (d=2s). Therefore, the distance H between the centers of the conductors 11 of the electric wires 2 and 3 is at least twice the diameter of the conductor 11 ($H \geqq 2d$), and as compared with the case where the conductors 11 are in contact, the high frequency effective resistance greatly reduces and so does the loss due to resistance. In addition, when the high frequency is 10 kHz, the diameter d of the conductor 11 is preferably about 1 mm. As a result, the multiconductor cable 1 can be used as a high frequency current multiconductor cable.

Figure 3:
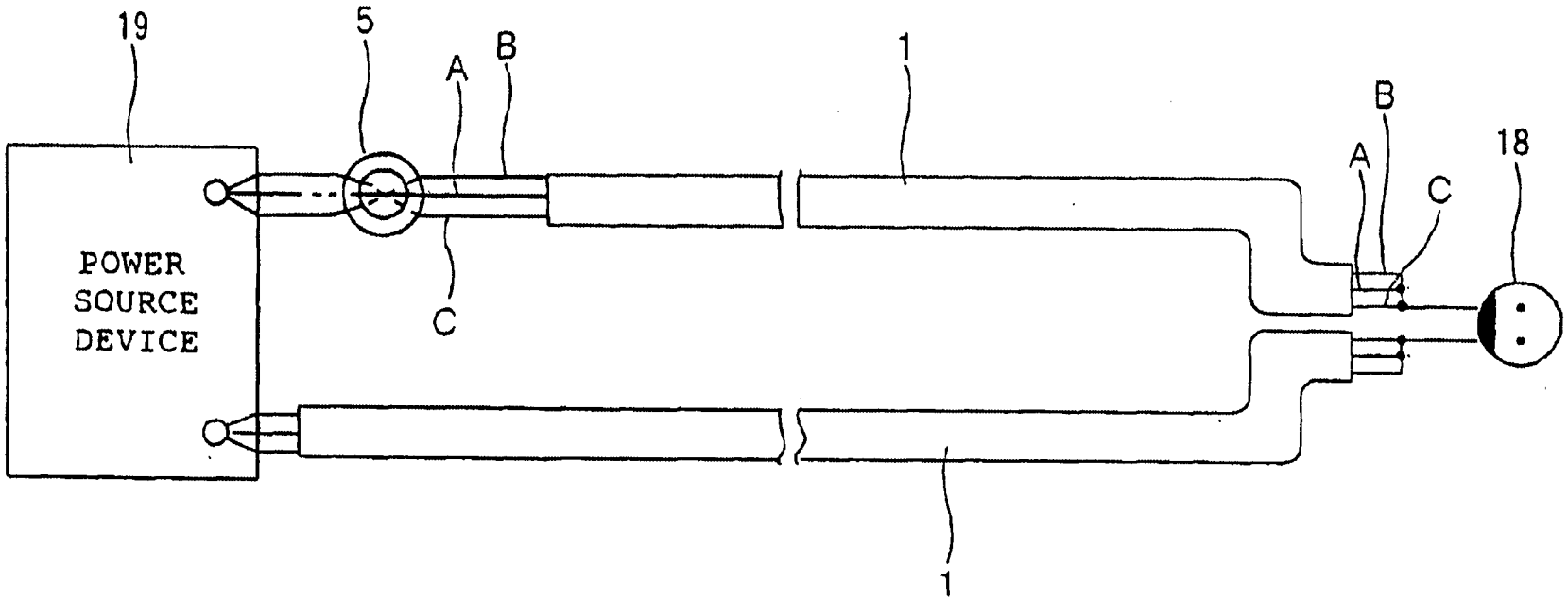
FIG. 3 is a circuit diagram of the feeding equipment.

FIG. 3 is a circuit diagram of a feeding equipment using the high frequency current multiconductor cable for feeding high frequency current.

A single ferrite body 5 constituting a current balancing circuit and two multiconductor cables 1 are connected between a receptacle 18 and a high frequency power source device (for example, 10 kHz/100 A power source device) 19.

By inserting the plug of an electric appliance to be used into the receptacle 18, a high frequency current is fed from the power source device 19 to the electric appliance.

Thus, when a high frequency current is to be fed, the provision of a single ferrite body 5 can suppress an increase in resistance caused by the proximity effect, enabling the multiconductor cables 1 to be used as high frequency current cables. Further, when cables are to be connected to the receptacle 18 and the power source device 19 by using the multiconductor cables 1, soldering is unnecessary, facilitating the terminal preparation to greatly improve the operating efficiency. Further, the use of the multiconductor cables 1 reduces the cost to about half of the cost involved in forming an induction line by a litz wire; thus, the cost can be greatly reduced.

Figure 4:
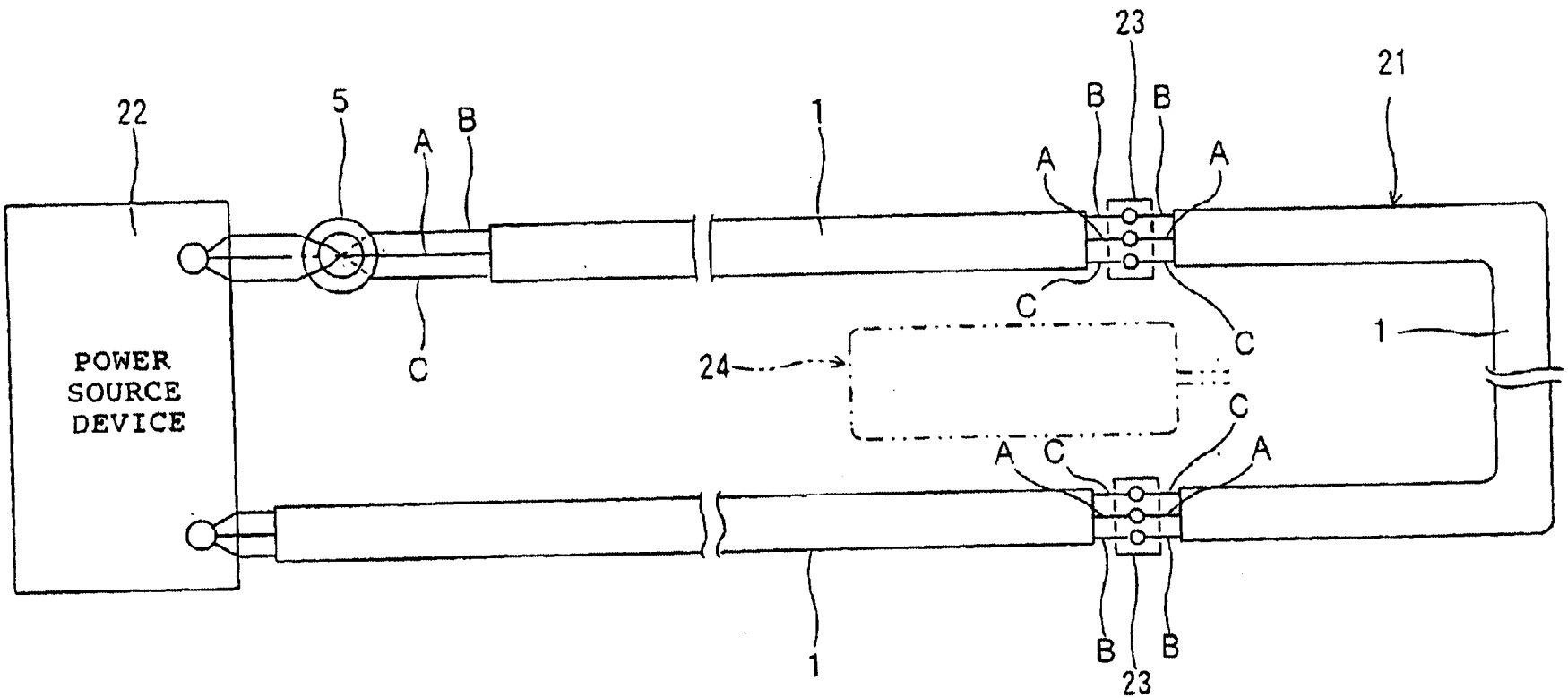
FIG. 4 is a circuit diagram of an induction line for a feeding equipment according to another form of the embodiment 1 of the invention.

FIG. 4 is a circuit diagram of a high frequency current feeding line (induction line) for a contactless feeding equipment (an example of feeding equipment) using the high frequency current multiconductor cable.

Three series-connected multiconductor cables 1 and a single ferrite body 5 are used to form an induction line 21 extending a long distance, for example, 200 m, and connected to a high frequency power source device (for example, 10 kHz/100 A) 22. Through a terminal block 23, the bundles A of inner electric wires 2 of the cables 1 are continuously connected and the bundles B and C of outer electric wires 3 are respectively continuously connected. The magnetic flux generated by this induction line 21 induces an electromotive force in a pickup coil 24 shown in phantom lines.

Thus, when the induction line 21 is to be formed over a long distance, an increase in resistance due to the proximity effect can be suppressed by only providing a single ferrite body 5, and the induction line 21 can be formed by using the multiconductor cables 1. Further, the use of the multiconductor cables 1 makes soldering unnecessary, facilitates the terminal preparation to greatly improve the operating efficiency in laying the cables, and reduces the cost to about half of the cost involved in forming an induction line by a litz wire; thus, the cost can be greatly reduced.

In addition, in the embodiment 1, the ferrite body 5 is used as an example of magnetic material, but any other material may be used provided that its permeability for high frequencies is high and that it will have no eddy current generated therein; for example, amorphous magnetic material may be used. Further, the ferrite body 5 is ring-shaped, but any other shape may be used provided that it has a through-hole 6.

Figure 5:
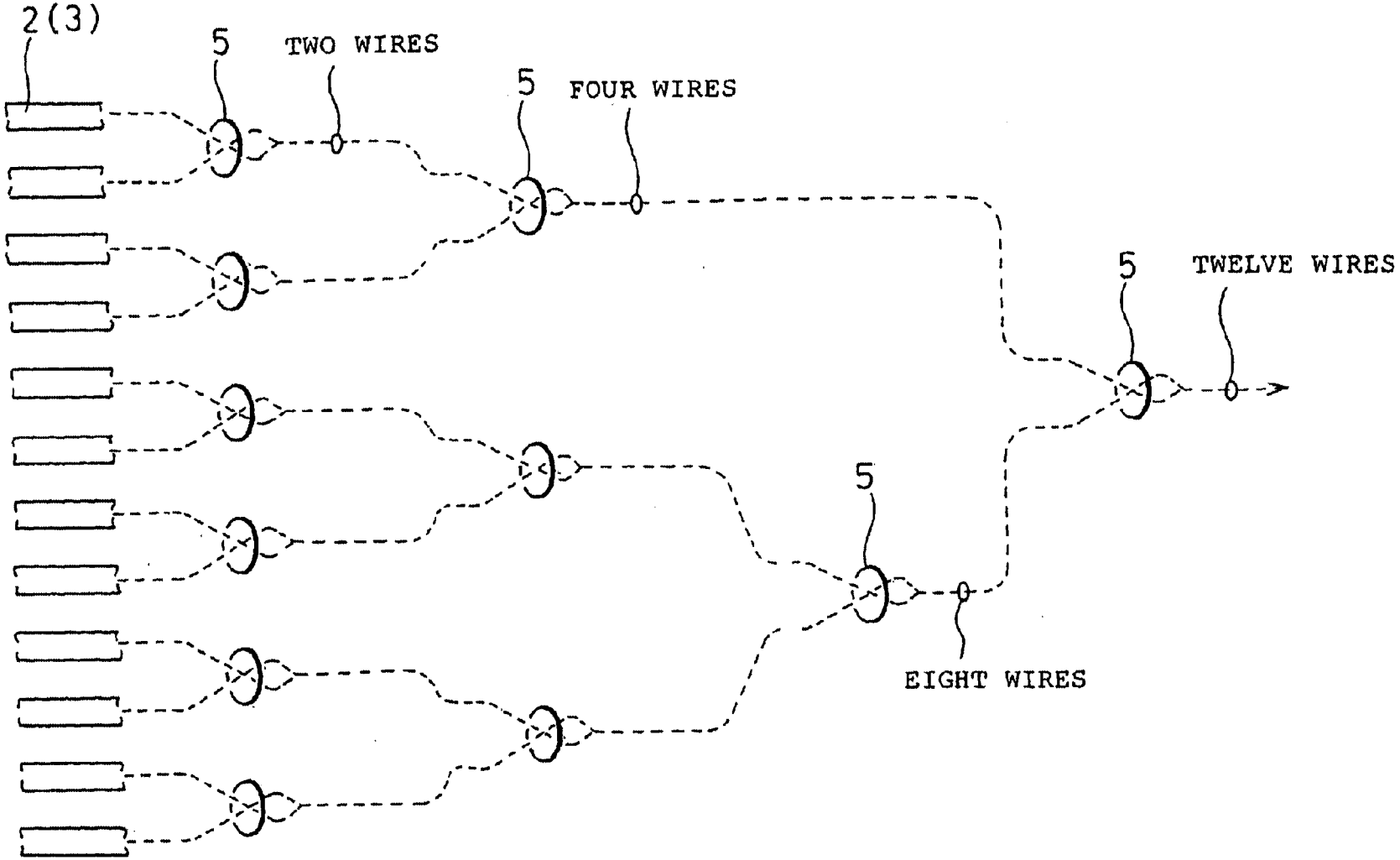
FIG. 5 is a principal structural view of a high frequency current multiconductor cable used as a line for passing high frequency current for a feeding equipment according to another form of the embodiment 1.

Further, in the embodiment 1, a single ferrite body alone is used to form a current balancing circuit, but, as shown in FIG. 5, a current balancing circuit can be formed by crosswise passing adjoining electric wires 2, 3 through a ferrite body 5, gathering the thus-passed electric wires into a bundle, crosswise passing this bundle and another bundle crossing another ferrite body 5 through a further ferrite body 5, this operation being repeated in order. However, as shown in FIG. 1, by gathering the electric wires equispaced from the center of the cable into bundles A, B, and C, it is possible, as compared with the case of passing the electric wires 2, 3 one by one through the ferrite body 5, to reduce the number of required ferrite bodies 5, to facilitate the operation for passage through the ferrite body 5, to improve the efficiency of laying operation, and to reduce the cost.

Figure 6:
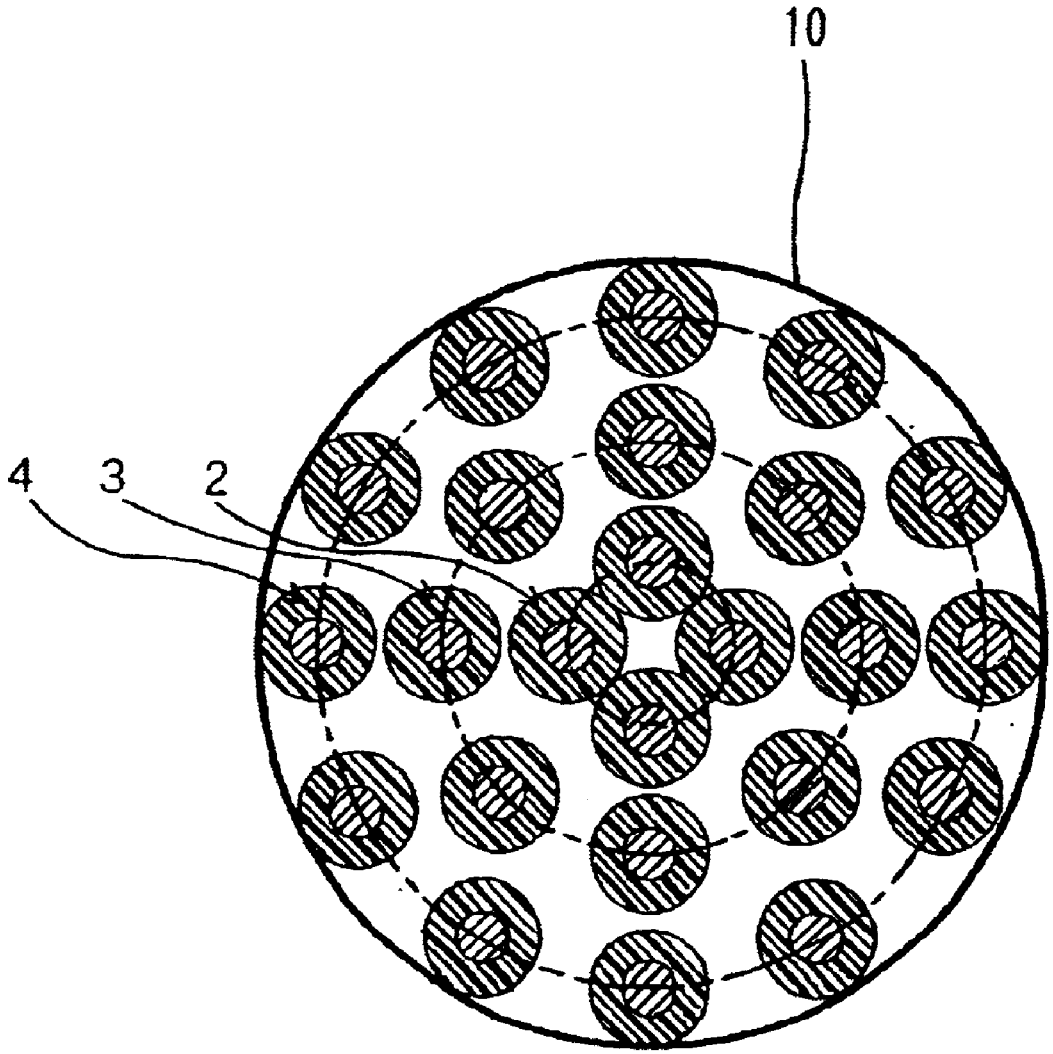
FIG. 6 is an explanatory view, in section, of the electric wires of a high frequency current multiconductor cable for a feeding equipment according to another form of the embodiment 1.

Further, in the embodiment 1, the multiconductor cable 1 is formed of two layers of electric wires 2 and 3, but it is also possible to form a multilayer by arranging electric wires which are equispaced from the center of the cable and whose number is a integral multiple of the number of inner electric wires 2, on the outside of the electric wires 3. FIG. 6 shows a cross section of a three-layer construction. The three-layer construction is formed by arranging 12, or three times the number of inner electric wires 2, electric wires 4 equispaced from the center of the cable, on the outside of the electric wires 3.

Embodiment 2

In the embodiment 1, the multiconductor cable 1 is used to pass an electric current for one circuit. In the embodiment 2, it is used as a cable to pass different electric currents for two circuits.

Figure 7:
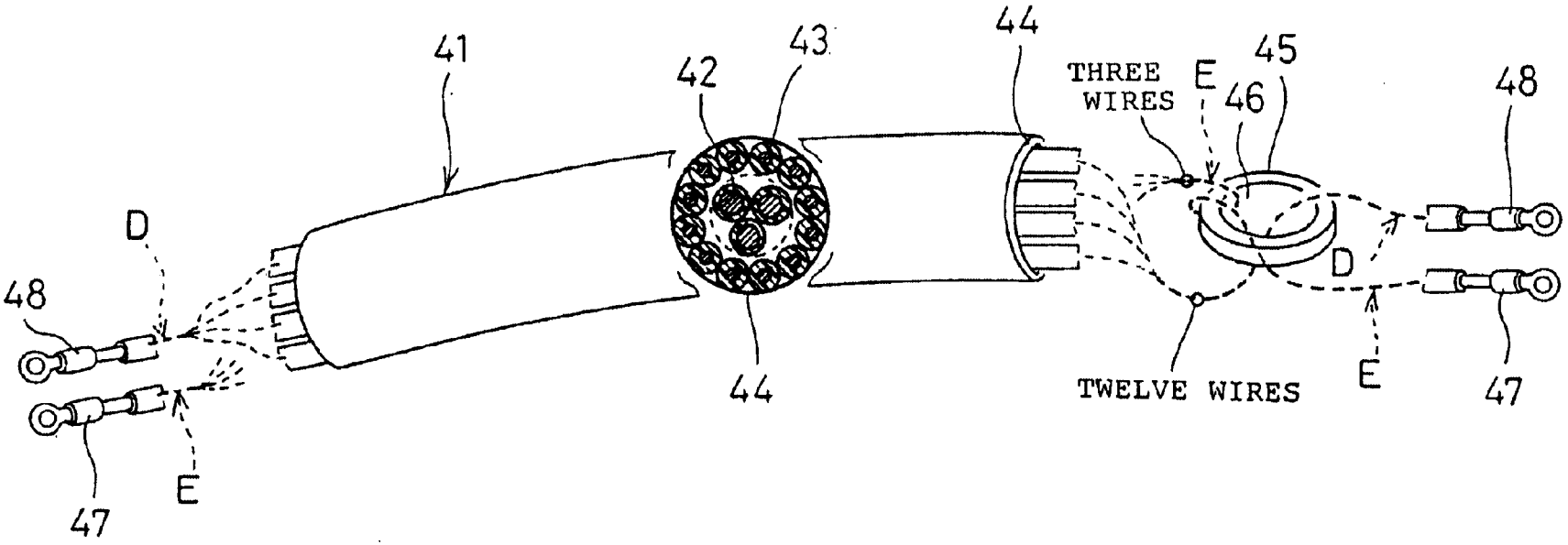
FIG. 7 is a structural view, partly in section, of a high frequency current multiconductor cable used as a line for passing high frequency current for a feeding equipment in an embodiment 2 of the invention.
Figure 8:
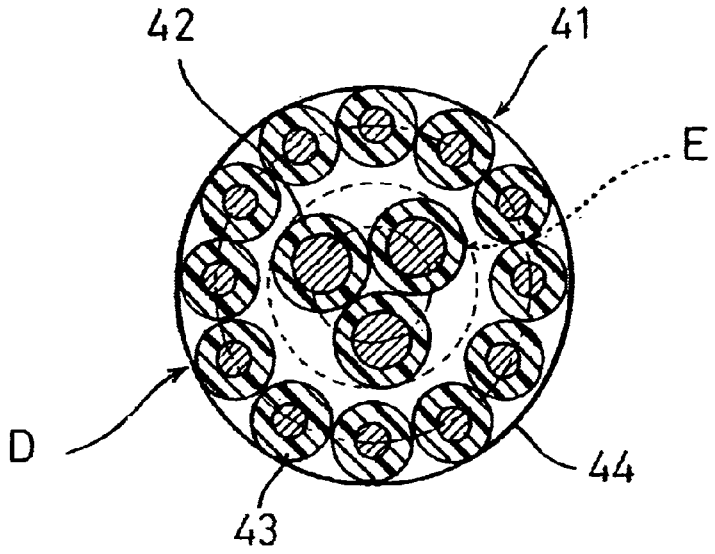
FIGS. 8(*a*) & 8(*b*) are an explanatory view, in section, of the electric wires of the high frequency current multiconductor cable for the feeding equipment.
Figure 8:
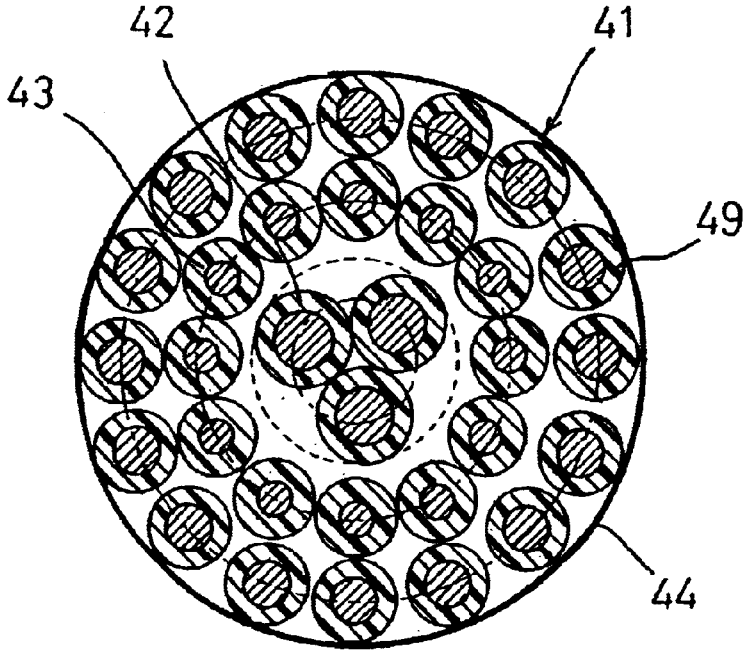

In FIG. 7, the numeral 41 denotes a multiconductor cable comprising, as shown enlarged in FIG. 8(*a*), three inner electric wires (core wires) 42 equispaced from the center of the cable 41, and 12 outer electric wires 43 disposed outwardly thereof and equispaced from the center. The numeral 44 denotes a cover for the multiconductor cable 41.

Let $S_1$ be the cross sectional area of the conductor of each of the 12 outer electric wires 43, $S_2$ be the cross sectional area of the conductor of each of the three inner electric wires 42, $I_1$ be the current flowing through each of the 12 outer electric wires 43, and $I_2$ be the current flowing through each of the three inner electric wires 42, then the following relation holds:

$I_1/S_1=I_2/S_2=K$ (constant). That is, the current density (the current per unit cross sectional area of the conductor) is constant.

For example, if the cross sectional area $S_1=0.75$ mm$^2$, the cross sectional area $S_2=1.5$ mm$^2$, that is, if $S_2=2\ S_1$ and the current $I_1=5$ A, then the current $I_2=10$ A.

In addition, let D be the bundle of outer electric wires 43 and E be the bundle of inner electric wires 42.

Further, in FIG. 7, the numeral 45 denotes a ring-shaped ferrite body (an example of magnetic material) constituting a current balancing circuit, and with respect to the ferrite body 45, the outer and inner bundles D and E are passed through the hole 46 in the ferrite body 45 in opposite directions, as illustrated. At this time, the overall area $W_1$ ($=\Sigma S_1$) of the cross sectional area $S_1$ of each electric wire 43 of the outer bundle D and the overall area $W_2$ ($=\Sigma S_2$) of the cross sectional area $S_2$ of each electric wire 42 of the inner bundle E are calculated and the ratio n (which is a positive integer) between the overall area $W_1$ and the overall area $W_2$ is calculated. A bundle of electric wires associated with of this ratio n is wound n times around the ferrite body 45.

For example, when $w_1/W_2$ is 2, the inner bundle E is wound twice around the ferrite body 45, and, reversely, when $W_2/w_1=2$, the outer bundle D is wound twice around the ferrite body 45.

In FIG. 7, $W_1=12\times0.75=9$ mm$^2$, $W_2=3\times1.5=4.5$ mm$^2$; therefore, the inner bundle E is wound twice around the ferrite body 45.

Such way the bundles D and E of electric wires are wound around the ferrite body 45 equalizes the current values provided by the inner and outer bundles E and D of electric wires crosslinking the ferrite body 45, thereby canceling the counter electromotive force produced from the difference in spatial arrangement when the inner and outer electric wires 42 and 43 of the multiconductor cable 41 are twisted together, so that the circulating current due to the proximity effect is cut off, with the result that an increase in resistance due to the proximity effect is prevented and the resistance loss is reduced. As a result, it becomes possible to use the multiconductor cable 41 as a high frequency current cable.

In FIG. 7, the numerals 47 and 48 denote crimp terminal crimped to both ends of the bundles D and E of electric wires.

Figure 9:
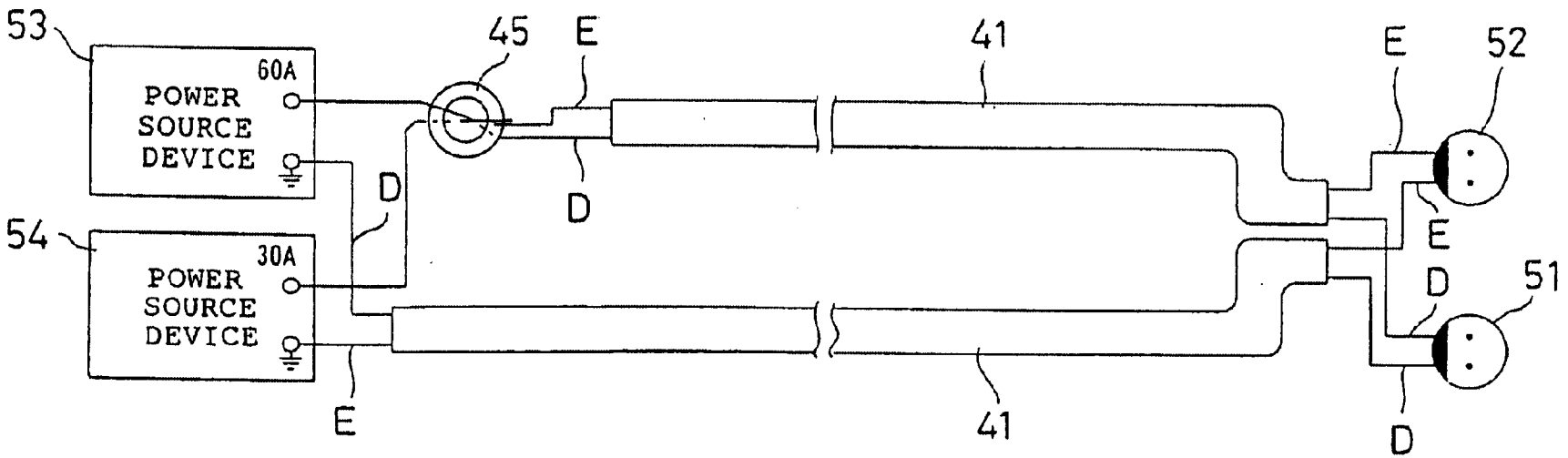
FIG. 9 is a circuit diagram of the feeding equipment.

FIG. 9 is a circuit diagram of a feeding equipment using the high frequency current multiconductor cable 41 for feeding high frequency current.

A single ferrite body 45 constituting a current balancing circuit and two multiconductor cables 41 are connected between two receptacle 51, 52 and twp high frequency power source devices (for example, a 10 kHz/60 A power source device and a 10 kHz/30 A power source device) 53, 54.

By inserting the plug of an electric appliance to be used into the receptacle 51, a high frequency current is fed from the power source device 53 to the electric appliance, and by inserting the plug of an electric appliance to be used into the receptacle 52, a high frequency current is fed from the power source device 54 to the electric appliance.

Thus, when two different high frequency currents are to be fed, the provision of a single ferrite body 45 can suppress an increase in resistance caused by the proximity effect, enabling the multiconductor cables 41 to be used as a two-circuit high frequency current cables. Further, when cables are to be connected to the receptacles 51, 52 and the power source devices 53, 54 by using the multiconductor cables 41, soldering is unnecessary, facilitating the terminal preparation to greatly improve the operating efficiency. Further, the use of the multiconductor cables 41 reduces the cost to about half of the cost involved in forming an induction line by a litz wire; thus, the cost can be greatly reduced.

Figure 10:
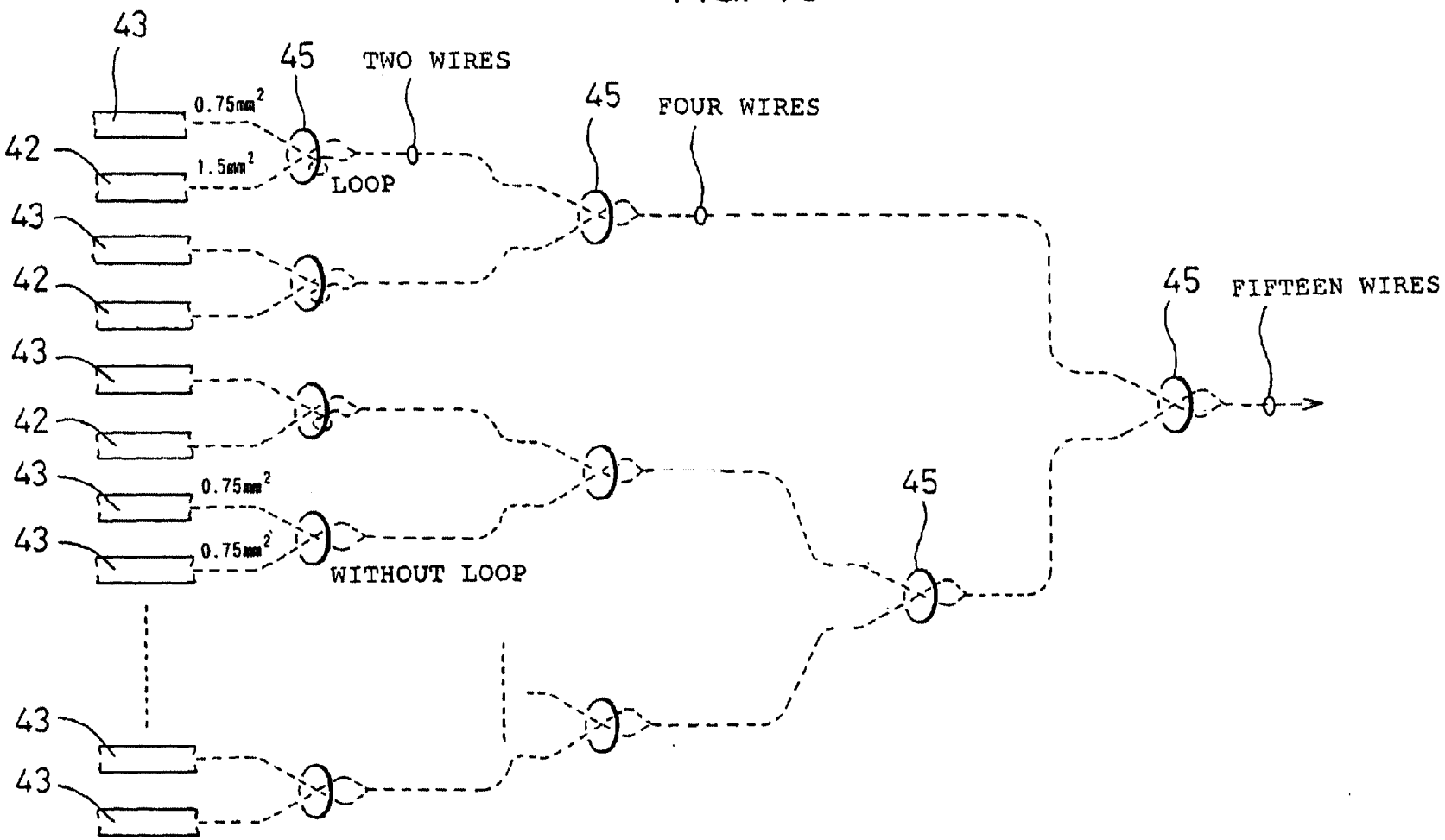
FIG. 10 is a principal structural view of a high frequency current multiconductor cable used as a line for passing high frequency current for a feeding equipment according to another form of the embodiment 2.

Further, in the embodiment 2, a single ferrite body alone is used to form a current balancing circuit, but, as shown in FIG. 10, a current balancing circuit can be formed by crosswise passing adjoining electric wires 42, 43 through a ferrite body 45 and winding them therearound, gathering the thus-passed electric wires into a bundle, crosswise passing this bundle and another bundle crossing another ferrite body 45 through a further ferrite body 45, this operation being repeated in order.

Further, in the embodiment 2, the multiconductor cable 41 is formed of two layers of electric wires 42 and 43, but it is also possible to form a multilayer by arranging electric wires equispaced from the center of the cable, on the outside of the electric wires 43. FIG. 8(*b*) shows a cross section of a three-layer construction. The three-layer construction is formed by arranging electric wires (core wires) 49 equispaced from the center of the cable and having the same current density, on the outside of the electric wires 43.

Figure 11:
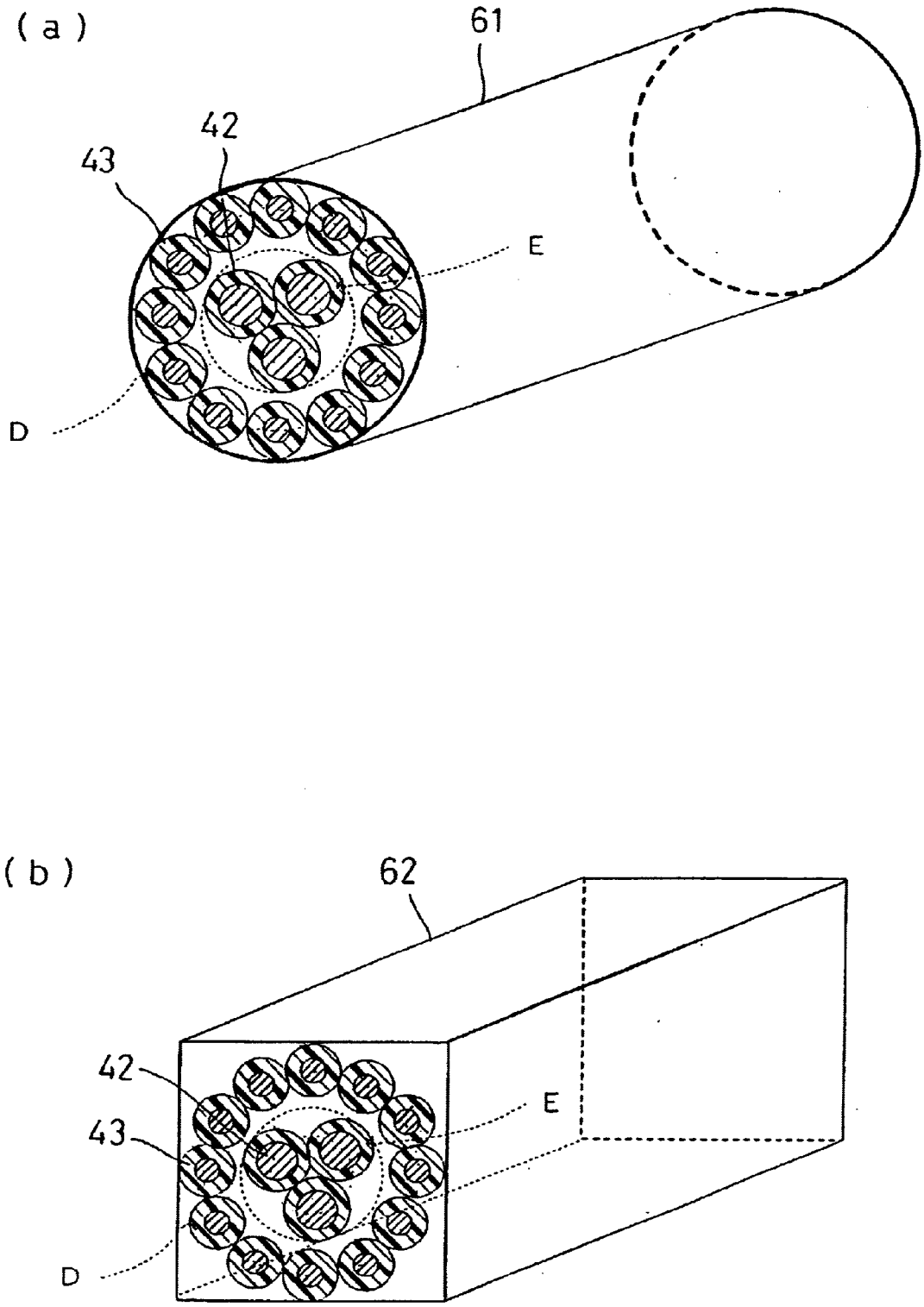
FIGS. 11(A) & 11(B) are a principal structural view of a high frequency current multiconductor cable used as a line for passing high frequency current for a feeding equipment according to another form of the embodiment 2.
Figure 12:
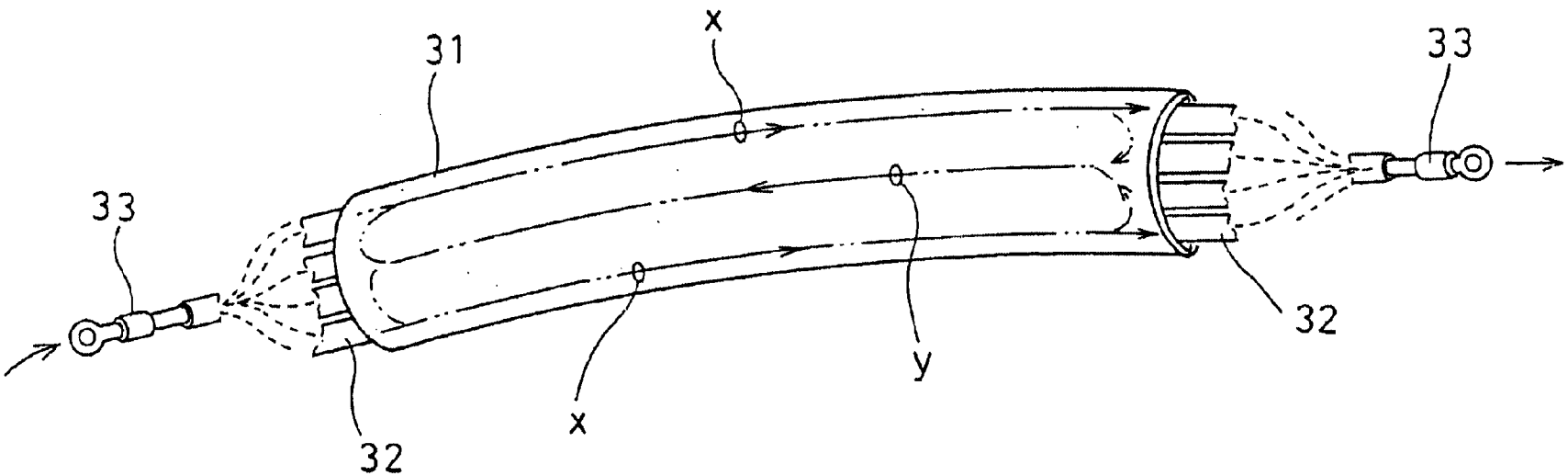
FIG. 12 (PRIOR ART)
FIG. 12 is a view for explanation of problems in a known multiconductor cable.

Further, in the embodiments 1 and 2 described above, the feeders are formed by covering electric wires 2, 3, 42 and 43 with covers 10 and 44. However, instead of these covers 10 and 44, as shown in FIG. 11, wiring ducts of polyvinyl chloride (or wiring pits) 61 and 62 of circular or polygonal cross section which do not interfere with feeding, for example, may be installed with electric wires 42 and 43 (electric wires 2 and 3) disposed therein, thus forming a feeder.

What is claimed is:

1. A high frequency current multiconductor cable, comprising a plurality of covered electric wires fed with high frequency single-phase current being divided and allowed to flow in each of said wires, said wires each comprising a conductor and a cover of said conductor, characterized in that a magnetic body having a through-hole is provided, and the electric wires equi-distanced from a center of said cable are bundled or grouped and each bundle or group of electric wires is allowed to pass through said through-hole in such a manner that ampere-turns or current densities become the same, whereby current phases and current values of said plurality of wires are forced to be substantially the same.

2. A high frequency current multiconductor cable as set forth in claim 1, characterized in that the diameter of the conductor of each electric wire is equal to twice the sum of a thickness of the cover of the conductor.

3. A high frequency current multiconductor cable as set forth in claim 1 or 2, characterized in that a number of outer electric wires disposed externally of inner electric wires equi-spaced from the center of the cable is an integral multiple of a number of the inner electric wires.

4. A power feeding equipment for one or more movable bodies, comprising an induction line extending along a moving path of the one or more moving bodies and being supplied with a constant high frequency current from a power source device, and a pickup coil provided in each moving body and being fed with power from said induction line in a contactless manner, characterized in that said induction line is formed by using the high frequency current multiconductor cable as set forth in claim 1 or 2.

* * * * *

UNITED STATES PATENT AND TRADEMARK OFFICE

CERTIFICATE OF CORRECTION

PATENT NO. : 6,649,842 B1
DATED : November 18, 2003
INVENTOR(S) : Shuzo Nishino

It is certified that error appears in the above-identified patent and that said Letters Patent is hereby corrected as shown below:

Title page,
Item [22], PCT Filed:, replace "Feb. 10, 1999" with -- Feb. 3, 2000 --.

Signed and Sealed this

Twenty-seventh Day of April, 2004

JON W. DUDAS
*Acting Director of the United States Patent and Trademark Office*